United States Patent [19]

Roehrig, Jr.

[11] Patent Number: 4,777,743

[45] Date of Patent: Oct. 18, 1988

[54] READY WEIGHT SHOE

[76] Inventor: August E. Roehrig, Jr., 5776 W. Ainslie St., Chicago, Ill. 60630

[21] Appl. No.: 38,910

[22] Filed: Apr. 16, 1987

[51] Int. Cl.[4] ..... A43B 5/00

[52] U.S. Cl. ..... 36/132; 36/136; 272/96; 272/119

[58] Field of Search ..... 36/132, 136, 89; 272/96, 119

[56] References Cited

U.S. PATENT DOCUMENTS

| | | | |
|---|---|---|---|
| 2,742,715 | 4/1956 | Meltzer | 36/136 X |
| 3,114,982 | 12/1963 | McGowan | 36/132 |
| 3,366,380 | 1/1968 | Montour | 272/96 X |
| 3,419,974 | 1/1969 | Lange | 36/89 |
| 3,427,020 | 2/1969 | Montour et al. | 36/132 X |
| 4,384,414 | 5/1983 | Gamm | 36/132 |
| 4,458,432 | 7/1984 | Stempski | 36/132 |

FOREIGN PATENT DOCUMENTS

| | | | |
|---|---|---|---|
| 2139103 | 11/1984 | United Kingdom | 272/119 |

*Primary Examiner*—John M. Jillions
*Attorney, Agent, or Firm*—Wall and Roehrig

[57] ABSTRACT

An athletic, sport, or leisure shoe utilizing a portion thereof for incorporating training weights to increase the resistance applied against the user's legs which must be overcome when training or exercising.

12 Claims, 1 Drawing Sheet

READY WEIGHT SHOE

BACKGROUND OF THE INVENTION

This invention relates in general to footwear and, in particular, to an athletic, sport, or leisure shoe for use in exercising or in practicing for sporting events. More specifically, but without restriction to the particular embodiments and/or use which are shown and described for purposes of illustration, this invention relates to an exercise shoe which can be selectively weighted for increasing leg strength, improving quickness of movement, or used in general walking to burn off extra calories.

Many participants in sporting events or recreational sports participants exercise to increase leg strength, stamina and to improve the player's ability to excel at the sport. Running or jogging while carrying extra weight is believed to increase leg strength, quickness of movement, stamina or endurance as well as working the cardiovascular system and burning off excess body fat. Various ways of increasing or adding extra weight while exercising have included wearing a weight belt, weight vest or jacket, or wearing ankle or wrist weights which comprise bands of material containing weight. Wrist or ankle weights are worn about the wrist or the ankles and secured by straps, snaps or hook-and-loop fastening systems such as sold under the trademark "VELCRO".

In using ankle weights to increase leg strength, quickness and/or stamina etc., one of the problems generally encountered is that the weights rub or chafe the skin causing discomfort and blisters. If such weights are worn for a sustained period of time, the constant localized pressure on the foot and/or ankles is uncomfortable frequently causing soreness where the weight bears against the body. When running or jogging, the inertia of the weight mass may also impose a twisting force on the foot.

While exercising with increased weight is desirable to improve sports proficiency or improved physical conditioning, those devices presently available suffer from these above shortcomings.

SUMMARY OF THE INVENTION

It is, therefore, an object of this invention to improve weight training devices worn on the body.

Another object of this invention is to permit extra weight to be easily added to athletic footwear.

A further object of this invention is to decrease chafing and blister formation when running, jogging or exercising with increased leg weights.

Still another object of this invention is to incorporate additional training weight into a sport, leisure or athletic shoe.

Yet another object of this invention is to permit readily varying the amount of weight added during exercising or training in a convenient and easy manner.

These and other objects are attained in accordance with the present invention wherein there is povided an athletic, sport, or leisure shoe utilizing a portion thereof for incorporating training weights to increase the resistance applied against the user's legs which must be overcome when training or exercising.

DESCRIPTION OF THE DRAWINGS

Further objects of the invention, together with additional features contributing thereto and advantages accruing therefrom, will be apparent from the following description of preferred embodiments of the invention which are shown in the accompanying drawings with like reference numerals indicating corresponding parts throughout wherein.

DESCRIPTION OF THE PREFERRED EMBODIMENTS

Figure 1:
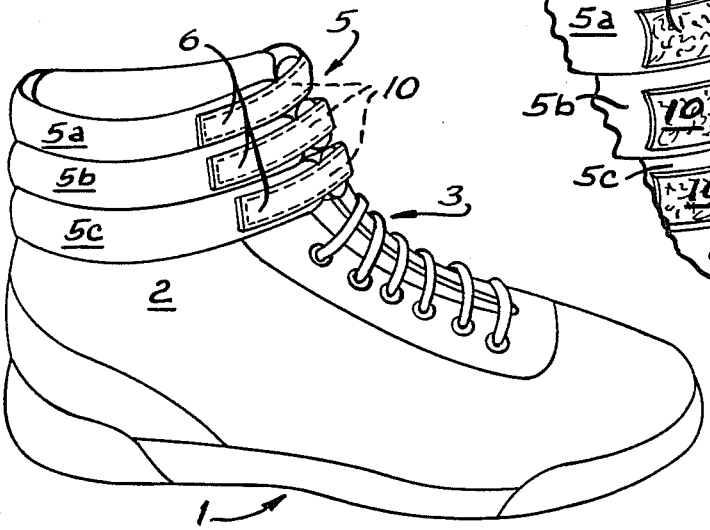
FIG. 1 is a perspective view of an athletic or sports shoe which includes a tie or lace in the front portion and having a collar portion which is secured about and/or above the user's ankle by means of a releasable hook-and-loop fastening system.
Figure 2:
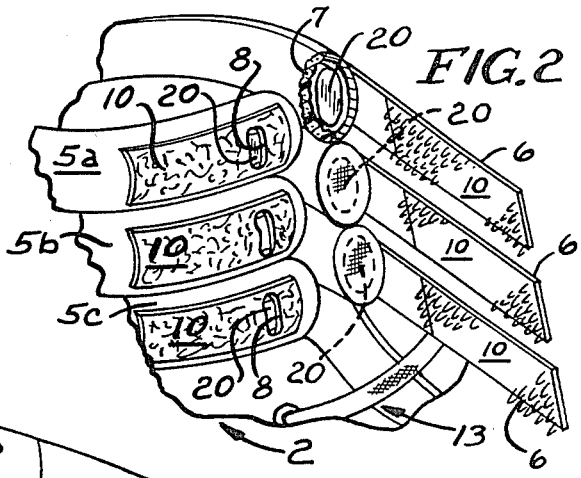
FIG. 2 is an enlarged view of a portion of the shoe shown in FIG. 1 with the collar fasteners shown open to reveal an opening through which weighted material may be added to the collar for increasing the weight against which the user will be exerising.

Referring now to the embodiment of the invention shown in FIGS. 1 and 2, there is shown an athletic, sport or leisure shoe of the high top or high collar type having a sole portion 1, an upper portion 2, a lace or tie closure 3 and an upstanding weight-receiving collar portion 5 which generally fits about or above the user's ankles. In this embodiment, the collar portion 5 is formed as a series of three rolled sections 5*a*, 5*b* and 5*c*, each of which is closed about the user's leg by means of a strap 6 using a conventional hook and loop releasable closure system 10 sold under the trademark "VELCRO" and disclosed in U.S. Pat. No. 3,114,951. The collar sections 5*a*, 5*b* and 5*c* of the collar 5 are formed in a generally tubular configuration, and include a portion or quantity of padding material 7 positioned against the inner portion of the collar 5 to cushion the user's leg and/or ankle against a selectively added weight 20 which is placed within the collar.

Athletic, sport or leisure shoes constructed with a collar formed as a singular tubular section, or multiple tubular sections, are known to those skilled in the art and are commercially available. The collars of such shoes, however, are filled with a cushioning material which functions to cushion or protect the ankle.

The collar 5 of the instant invention may be formed by folding the shoe material from which the upper portion 2 is constructed, upon itself, and stitching the folded portion to form a tubular collar 5, or by using two or more pieces of material which are stitched together forming a tubular chamber or pocket 5 between spaced lines of stitching. A weight-receiving access opening 8 is formed in the tubular chambers or pockets 5*a*, 5*b* and 5*c* through which weights 20 are selectively added.

Each of the fastening straps 6 functions to secure one portion of the collar 5 to the other about the wearer's foot. When the shoe is positioned on the wearer's foot, the straps 6 are pulled across the foot to secure the shoe. At that time, the strap 6 also functions to cover the weight-receiving access opening 8, formed on the other side of the collar and through which weight material 20, such as short material or bar weight, is added. If preferred, a weight in the form of a malleable bar may be inserted through the opening 8. Such a weight, formed from a bendable material such as lead, upon insertion through the hole 8, may be preformed for insertion or may be formed or shaped while passing through the collar to the opposite or closed end thereof. The free end of the weight bar can then be passed entirely through the opening 8, and positioned or tucked against the closed end of the collar portion adjacent to the entrance or access opening 8.

As can be seen, both the quantity of the weight as well as the type of weight which is added into the collar portion may be varied. A plurality of weight-receiving portions may be utilized, as illustrated in FIGS. 1 and 2, or a single weight-receiving portion may be used as illustrated in the other drawings.

Figure 4:
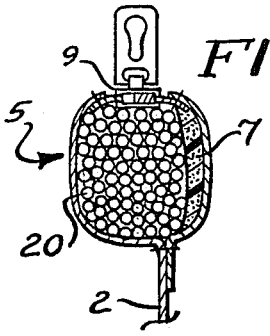
FIG. 4 is an enlarged cross-sectional view of the collar portion of the shoe illustrated in FIG. 3 taken along lines 4—4 to better illustrate the interior construction.
Figure 3:
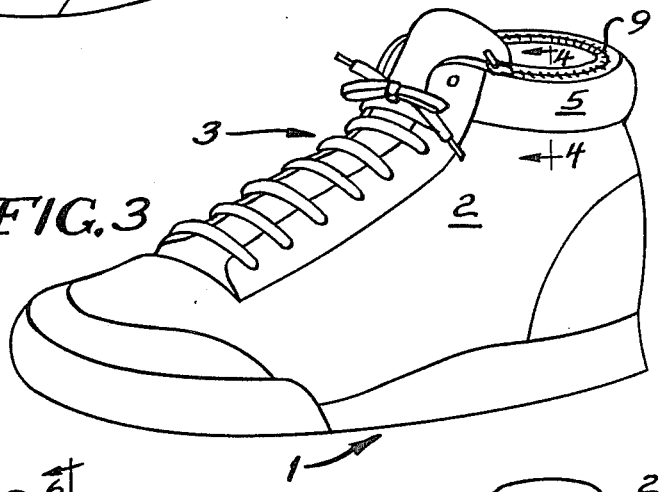
FIG. 3 is an illustration of another embodiment of an athletic shoe wherein the collar portion is positioned about the user's foot and incorporates a zipper for providing access to the interior of the collar portion for adding or removing the added weights.

As shown in the embodiment of the invention shown in FIGS. 3 and 4, the hightop type shoe may be constructed with a single collar or tubular chamber 5 secured on the upper portion 2 of the shoe. A zipper closure 9 is carried by the top portion of the collar 5, and may extend substantially about the entire collar, or only along a small portion at the rear of the shoe. The zipper closure 9 functions to permit the ready addition of weight 20 into the interior of the collar chamber 5, whether in the form of shot material (as illustrated in FIG. 4), U-shaped or malleable bars, or any other types of weight material depending upon the preference of the user.

Figure 5:
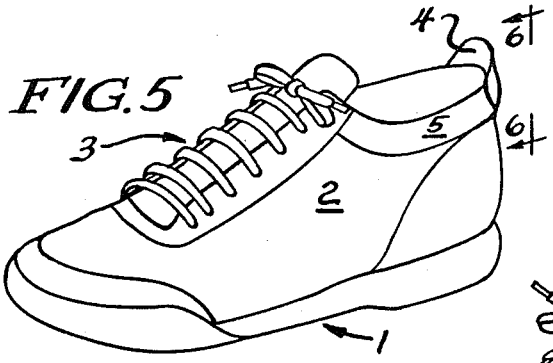
FIG. 5 is another embodiment of an athletic, sport, or leisure shoe of the sneaker or low-cut type with the weight containing collar being formed below the user's ankle.
Figure 8:
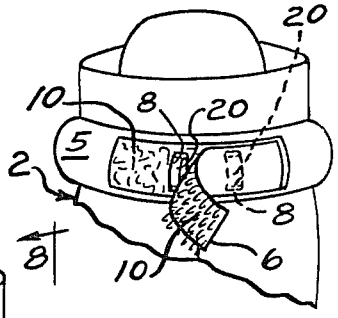
FIG. 8 is a partial rear profile of the shoe shown in FIG. 7 to better illustrate the manner in which weight can be added to the collar.
Figure 6:
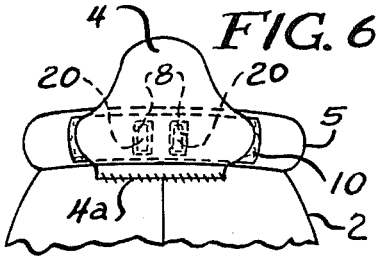
FIG. 6 is a partial rear profile view of the shoe shown in FIG. 5 to better illustrate the manner in which weight can be added to the collar.
Figure 7:
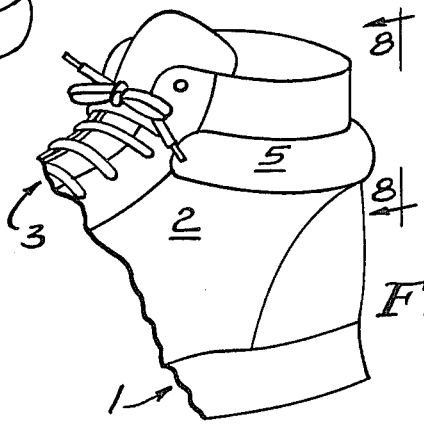
FIG. 7 is a partial perspective view of another shoe wherein the collar portion is positioned between the sole and uppermost part of the shoe.

Another embodiment of the invention is illustrated in FIGS. 5 and 6, wherein the invention is described with reference to a low-cut type of athletic or leisure shoe, sometimes referred to as a "sneaker". In this embodiment, the weight collar or chamber 5 is shown formed on the upper portion 2 of the shoe, but positioned beneath the user's ankle. In this embodiment, a pair of curved weights 2 may be inserted into the rear portion of the collar 5, as best shown in FIG. 6. A reinforcing gusset or strap 4, secured to the rear of the shoe 4*a*, and forming a part of a hook and loop fastening system 10, extends across to a complementary portion of the fastening system on the collar portion 5. When the reinforcing gusset of strap 4 is pulled across, it closes the access opening 8 through which the weight material is added. In the embodiment shown in FIGS. 7 and 8, the collar 5 is shown secured to an upper portion 2 of the shoe at a position between the sole 1 and the uppermost part of the upper portion 2. The strap 6, fastened to one side of the shoe, is pulled across the access opening 8 and secured by a hook-and-loop fastening system 10.

In the embodiment of the invention previously described, the weight material is added to the shoe itself and, therefore, overcomes the problems associated with a separate ankle band secured about a user's leg. The lacing of the athletic shoe, and securing of the shoe collar about the user's foot, secures the extra weight securely in position, eliminating chafing and blistering heretofore associated with weight addition by using a separate ankle band. In this manner, the user may readily vary the amount of extra weight incorporated into the shoe as the user's leg strength and/or endurance increases. By incorporating the extra weight into the shoe structure itself, twisting of the extra weight about the user's leg is eliminated, relative motion between the leg or foot and the extra weight is eliminated, and at the end of the training or exercise session the weight may be removed during relaxation.

While the invention has been described in the specification and illustrated in the drawings with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments illustrated by the drawings and described in the specification as the best mode presently contemplated for carrying out this invention, but that the invention will include all embodiments falling within the description or scope of the appended claims.

What is claimed is:

1. In an exercise, athletic, sport or leisure shoe having a sole portion, a shoe upper portion secured to the sole portion, a closure portion which secures the shoe upon a user's foot within the upper portion of the shoe, and a collar portion formed on the shoe upper portion generally encircling the user's ankle, the improvement comprising:

weight-retaining pocket means formed in said collar portion for retaining weight material within said collar portion adjacent to the user's ankle to provide an increased weight against which a user of the shoe must work when exercising.

2. the shoe as set forth in claim 1 wherein said collar portion is carried on said shoe upper adjacent to the user's ankle at a position above a user's ankle when the shoe is positioned on a user's foot.

3. The shoe as set forth in claim 1 wherein said collar portion is carried on said shoe upper adjacent to the user's ankle at a position below a user's ankle when the shoe is positioned on a user's foot.

4. The shoe as set forth in claim 1 wherein said collar portion includes a closable opening formed therein through which a quantity of weight material may be placed into said collar portion.

5. The shoe as set forth in claim 4 wherein said closable opening includes a hook-and-loop releasable closure system.

6. The shoe as set forth in claim 4 wherein said closable opening includes a zipper.

7. The shoe as set forth in claim 4 wherein said weight material is in the form of spheres.

8. The shoe as set forth in claim 4 wherein said weight material is in the form of malleable bars.

9. The shoe as set forth in claim 4 wherein said weight material is in the form of curved bars.

10. The shoe as set forth in claim 1 wherein said collar portion is formed as a plurality of parallel chambers extending circumferentially about said upper portion of the shoe.

11. The shoe as set forth in claim 1 wherein said collar portion is formed in a hollow tubular configuration from the shoe upper being folded and stitched upon itself.

12. The shoe as set forth in claim 1 wherein said collar portion is formed in a hollow tubular configuration from two or more pieces of material from which said upper portion is formed being stitched together by substantiallly parallel rows of stitching

* * * * *